United States Patent [19]

Coles

[11] Patent Number: 4,956,921

[45] Date of Patent: Sep. 18, 1990

[54] METHOD TO IMPROVE DIRECTIONAL SURVEY ACCURACY

[75] Inventor: Mark Coles, Richmond, Tex.

[73] Assignee: Anadrill, Inc., Sugar Land, Tex.

[21] Appl. No.: 313,765

[22] Filed: Feb. 21, 1989

[51] Int. Cl.[5] ..... E21B 47/22

[52] U.S. Cl. ..... 33/304; 33/310; 33/312; 33/301; 33/302

[58] Field of Search ..... 33/304, 313, 310, 303, 33/302, 301, 300, 312

[56] References Cited

U.S. PATENT DOCUMENTS

| | | | |
|---|---|---|---|
| 4,163,324 | 8/1979 | Russell et al. | 33/313 |
| 4,231,252 | 11/1980 | Cherkson | 33/313 |
| 4,472,884 | 9/1984 | Eugebretson | 33/304 |
| 4,510,696 | 4/1985 | Rocsler | 33/313 |
| 4,682,421 | 7/1987 | Van Dougen et al. | 33/313 |
| 4,709,486 | 12/1987 | Walters | 33/304 |
| 4,761,889 | 8/1988 | Coberu et al. | 33/312 |
| 4,819,336 | 4/1989 | Russell | 33/313 |

FOREIGN PATENT DOCUMENTS

| | | | |
|---|---|---|---|
| 2086055 | 5/1982 | United Kingdom | 33/304 |
| 2122751 | 1/1984. | United Kingdom | 33/304 |

*Primary Examiner*—William A. Cuchlinski, Jr.
*Assistant Examiner*—William C. Dowling
*Attorney, Agent, or Firm*—Stephen L. Borst; John J. Ryberg

[57] ABSTRACT

A method is proposed for better determining the azimuth and inclination of a borehole in which a priori information regarding the magnitude of the earth's gravitational field strength, its magnetic field strength and direction are utilized to constrain the measured components of the earth's gravitational and magnetic field vectors. The constrained fit method adjusts the accelerometer and the magnetometer tri-axis measurements to optimize agreement between the measured data and the a priori magnetic and gravity field strengths and the magnetic dip angle. The adjustment that is selected is that which produces the least increase in the statistical measure $\chi^2$.

18 Claims, 1 Drawing Sheet

METHOD TO IMPROVE DIRECTIONAL SURVEY ACCURACY

BACKGROUND OF THE INVENTION

1. Field of the Invention

During the process of drilling a borehole in the search for producible hydrocarbons, the practice of drilling at an angle to the vertical (inclination) and in a specific direction (azimuth) is becoming more and more common. This so called directional drilling is usually performed in order to target a specific region in the earth (i.e., a specific geological formation) or to avoid hitting an object such as another well. In order to know where the borehole is being drilled so that its course may be corrected, downhole surveying instruments have been developed and employed. Such surveying instruments typically include a multi-axis accelerometer and a multi-axis magnetometer which measure at least two and preferably three components of the earth's gravitational and magnetic fields respectively. The azimuth and the inclination of the borehole at a particular point is then derived in a known manner from the information measured by the accelerometer and the magnetometer. In this process, it is assumed that the earth's gravitational and magnetic fields are unaffected by stray or spurious fields. If, however, the fields at the location of the measurement have been perturbed by extraneous fields, the determination of the azimuth and inclination of the borehole will be incorrect so that the driller will not know with the requisite degree of precision where the borehole actually is relative to his "target".

2. Description of the Prior Art

U.S. Pat. No. 4,163,324 describes a technique for correcting for errors that may affect a magnetic surveying instrument which result from stray magnetic fields arising from the equipment in the borehole. In that patent it is assumed that all interference is caused by magnetic material in the drillstring and is, therefore, axial. No means are provided for verifying the validity of this assumption. If the assumption is wrong, then the correction made to the azimuth measurement will also be wrong. Thus, the described technique would give incorrect results if the magnetic interference did not lie along the longitudinal axis of the tool as would be the case where the interference arose from an adjacent magnetic anomaly or from magnetized components in the tool having transverse magnetic fields.

U.S. Pat. No. 4,510,696 as well as the SPE/IADC publication 13476 "Reduction of Nonmagnetic Drill Collar Length Through Magnetic Azimuth Correction Technique" by A. W. Russel, point out that accelerometer and magnetometer measurements are subject to errors. This is especially true for the magnetometer whose measurement will be influenced by the presence of stray magnetic fields originating from magnetic materials in the vicinity of the magnetometer. The example cited by that patent is the magnetic field originating from the presence of the drill pipe which, unless made of non-magnetically permeable material, is likely to have a residual magnetic field. A further example is the stray magnetic fields that are present due to the proximity of other measurement equipment while drilling equipment containing magnetically permeable material.

While it is possible to place the surveying instrument within a non-magnetic drill collar with the instrument spaced sufficiently far from the origin of the stray field for the field to be small enough to have little or no influence on the measurements, such non-magnetic drill collars are costly. Indeed, it is the object of the above referenced patent and SPE/IADC paper to calculate the minimum length of non-magnetic drill collars (and thereby minimize the cost) that can be employed without incurring this interference.

Unfortunately, stray magnetic fields frequently result from components in the drilling assembly other than the drill collars. For example, various components of a downhole drilling motor or other downhole equipment may be magnetically permeable. Spacing these items sufficiently far from the surveying equipment may unacceptably constrain the design of the bottom hole assembly.

In an approach different from that of performing a calculation for determining the minimum size of non-magnetic drill collars, U.S. Pat. No. 4,682,421 describes a technique for detecting and removing constant magnetic biases from the transverse and axial magnetometer measurements. The technique requires the operator to make multiple surveys at various roll angles at a constant depth in a well in order to determine the cross axial component of the magnetic field bias due to magnetization of the drill collar.

In this technique, the X-axis magnetometer measurement is plotted versus the Y-axis magnetometer measurement (the Z-axis measurement lying along the longitudinal axis of the drill string) for each of the roll angles at which measurements are made. The resultant is a circle whose displacement from the origin is indicative of the horizontal X and Y magnetic biases. The longitudinal axis is then corrected by first subtracting the biases from the transverse axes and then computing the total magnetic field and the measured magnetic dip angle. The magnitude of the vector difference between the measured magnetic field and the tabulated magnetic field (obtained from a priori independent data) is then calculated. The vector difference between the measured magnetic field and the tabulated magnetic field is then used to obtain a corrected longitudinal magnetic field. Once these corrections are obtained they are applied to any individual survey to correct for the magnetic bias introduced into the measurement by the magnetic drill collar.

Several assumptions are implicit in the technique of U.S. Pat. No. 4,682,421. One assumption is that the transverse magnetic bias errors are fixed relative to the tool and are not due to, for instance, the position of some components of a mud motor which have additional internal degrees of freedom. A second assumption is that the magnetic bias errors are stable over time so that biases determined at the time of the calibration procedure can be used to correct data collected at other times. This assumption may not be entirely accurate in view of the shock and vibrations to which the drill string is subjected during the drilling process. A third assumption is that transverse bias errors dominate other causes of magnetic mismeasurement. For example, magnetometer alignment and scale factor errors are assumed to be small relative to the bias errors from stray fields when this may not be the case at all.

If these other error sources are the dominant cause of the resultant measurement error rather than the bias errors, the measured data will be degraded since erroneous biases will be subtracted from each sensor measurement. Likewise, if the magnetic biases are unstable, the data will also be corrupted.

U.S. Pat. No. 4,761,889 also describes a technique for addressing the problem of the effect of stray magnetic interference on a surveying device. This patent, as well as some of the other above mentioned techniques utilize a priori magnetic field magnitude and dip values to improve their results. None of the above mentioned techniques, however, attempts to take advantage of the additional a priori gravitational field strength information nor do they take into consideration the measurement uncertainties of the magnetometers and accelerometers.

The above techniques are therefore directed exclusively at magnetic field interferences and ignore potential errors in the accelerometer measurements. Since none of the above prior techniques takes into account measurement uncertainties that are design limitations of the magnetometer and accelerometer sensors themselves, they are unable to produce optimum results. Finally, none of the above techniques treats the three magnetometer axes and the three accelerometer axes on a equal basis. Rather, in those techniques, undue importance is given to the magnetometer z axis.

It would therefore be advantageous to have a technique for determining inclination and azimuth of a borehole that would beneficially utilize all of the a priori information available including gravitational field amplitude and measurement uncertainties. Desireably such a technique should perform corrections to the magnetometer and accelerometer measurements without requiring measurements from more than one orientation and one depth in the well bore in order to be self contained without having to assume that an interfering field is invariant from the beginning to the end of the survey of the borehole.

Furthermore it would be advantageous to have a technique which weighted the contributions of the measurements in accordance with the relative estimated uncertainties of the measurements but which otherwise treated all of the measurement axes on an equal basis. It would be of additional advantage to have a technique which could be varied in a manner such as to identify a faulty magnetometer or accelerometer axis. And finally, it would be of great advantage to have a technique that would be responsive not only to stray fields produced by objects within the borehole but which would have equal sensitivity to field anomalies originating outside of the borehole so that information relative to their location and distance could be obtained.

SUMMARY OF THE INVENTION

The shortcomings of the prior techniques for determining inclination and azimuth values having minimum errors from stray magnetic or gravitational fields are overcome by the present invention while at the same time providing additional significant benefits and objectives. Briefly, a tri-axis accelerometer and a tri-axis magnetometer carried by a drill string make measurements of the components of the earth's gravitational field and the earth's magnetic fields. These outputs are then corrected according to calibration factors and then are modified to be consistent with three a priori geophysical measurements which include the earth's gravitational field intensity, the earth's magnetic field intensity, and the earth's magnetic dip angle. In this method, an ensemble of accelerometer (gi) and magnetometer (hi) outputs at each measurement location are generated to be consistent with the a priori constraints. Improvement occurs since the three constraints cause the ensemble of the six measurements to have only three degrees of freedom. It is the reduction of the number of degrees of freedom which improves the results. From calculated outputs, $g_i$ and $h_i$, the inclination and azimuth of the borehole may be calculated using conventional formulas for inclination and azimuth.

Thus, a procedure which imposes a three constraint fit is performed by the method of Lagrange multipliers which minimizes the $\chi^2$ function $$\chi^2 = \sum_{i=1}^{3} \frac{(G_i - g_i)^2}{\sigma_{g,i}^2(\vec{g})} + \sum_{i=1}^{3} \frac{(H_i - h_i)^2}{\sigma_{h,i}^2(\vec{g},\vec{h})} + \lambda_1\left(G_o^2 - \sum_{i=1}^{3} g_i^2\right) + \lambda_2\left(H_o^2 - \sum_{i=1}^{3} h_i^2\right) + \lambda_3\left(G_o H_o \cos\eta - \sum_{i=1}^{3} g_i h_i\right)$$

with respect to $g_i$, $h_i$, and $\lambda_i$, where $G_i$ and $H_i$ are the measured and corrected (for bias, scale factor, and alignment errors) accelerometer and magnetometer components respectively. $G_o$, $H_o$, and cos $\eta$ are the a priori values of the earth's gravity field intensity, magnetic field intensity, and the cosine of the angle between the gravity and the magnetic field directions. The $\lambda_i$ are the Lagrange multipliers which introduce the constraint conditions into the minimization. The $\sigma_{g,i}(\vec{g})$ and $\sigma_{h,i}(\vec{g},\vec{h})$ are estimates of the uncertainties in the $G_i$ and the $H_i$ measurements. In the minimization procedure, nine non-linear simultaneous equations are produced which are then solved numerically (for example, by standard IMSL routines). ($\sigma_{g,i}$ and $\sigma_{h,i}$ are functions of orientation since they reflect uncertainties in the alignment and scale factor of the magnetometer and accelerometer axes. For this reason, they are shown in the above expressions as functions of $\vec{g}$ and $\vec{h}$, since these vectors determine the tool orientation.)

This solution results in values of $g_i$ and the $h_i$ (as well as values for the three Lagrange multipliers $\lambda_i$) which are improved estimates of the accelerometer and magnetometer outputs since they have been constrained to be consistent with the a priori data.

DESCRIPTION OF THE PREFERRED EMBODIMENT

Figure 1:
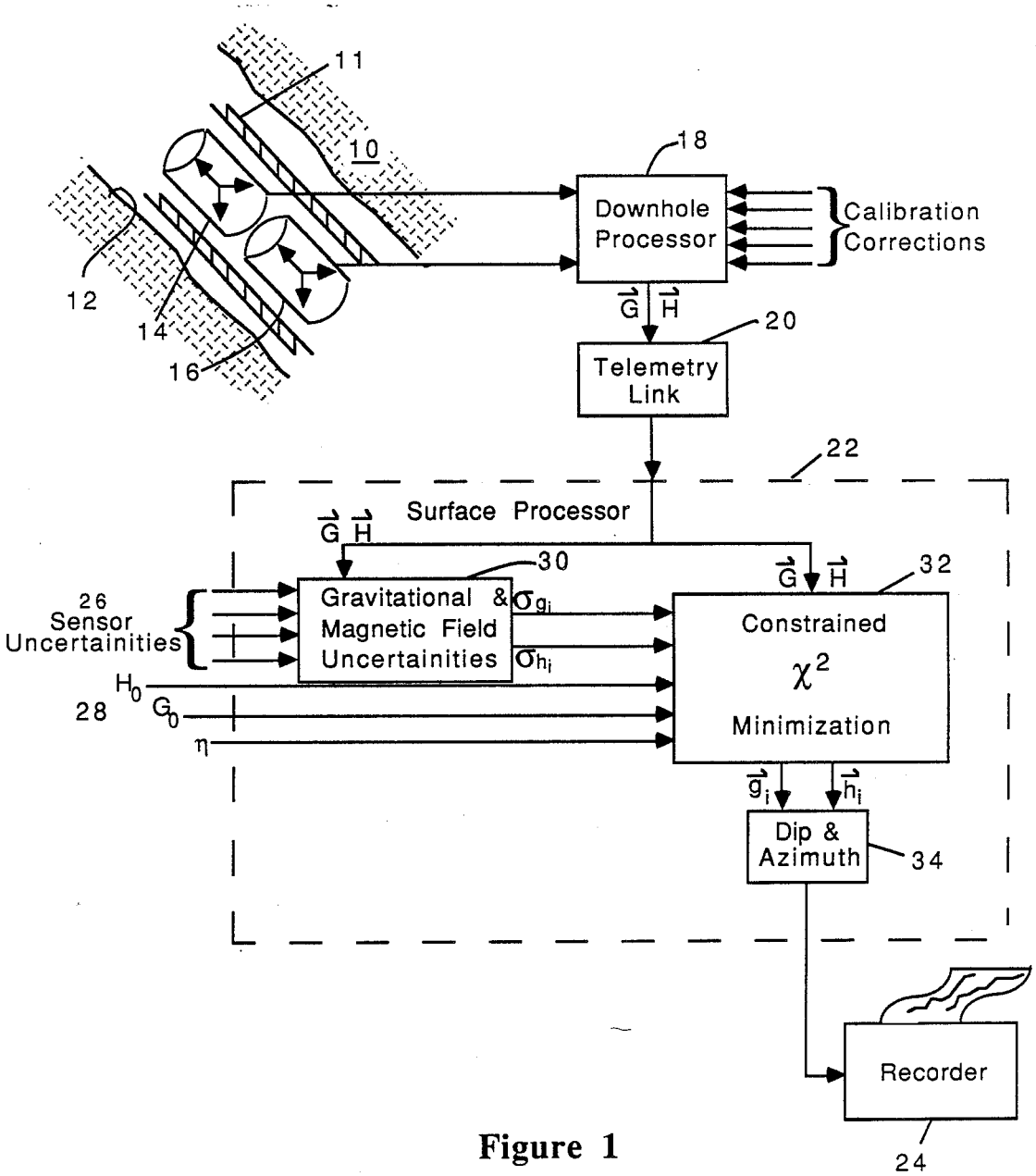
FIG. 1 is an illustration of a functional block diagram illustrating in a general way the functions and steps performed by a general or specific purpose digital computer in the practice of the invention.

In FIG. 1 there is illustrated a geological formation 10 which is being drilled by a conventional drilling procedure to form a borehole 12. As part of the drill string there is shown a drill collar 11 having therein surveying instrumentation which includes a tri-axial accelerometer 14 and a tri-axial magnetometer 16 for making measurements of the components of the earth's gravitational and magnetic fields. The outputs of the magnetometer and accelerometer are delivered to a downhole processor 18 which performs calibration corrections with respect to bias, scale factor and alignment errors that have previously been determined for that particular surveying instrument.

Upon undergoing the above corrections, the signals $H_i$, $G_i$, representing the outputs of the three accelerometers and the magnetometers, are either further processed down-hole to obtain determinations of inclination and azimuth or are sent up-hole by a mud pulse telemetry system 20 for further processing at the surface as illustrated in processor 22. Processor 22 comprises any standard, suitably programmed special or general purpose digital computer, as for example the PDP 11/35 digital computer.

In the inventive procedure, the previously corrected values of the components of the measured magnetic and gravitational fields, $G_i$ and $H_i$ are then modified at functional block 32 to be consistent with three a priori geophysical measurements 28 which include the scalar magnitude of the earth's gravitational field ($G_o$), the scalar magnitude of the earth's magnetic field intensity ($H_o$), and the complement of the earth's magnetic dip angle ($\eta$). These three a priori quantities may be obtained by reference to standard look up tables by knowing the latitude and longitude of the location of the well, or by actual measurement at the well site.

The procedure practiced at 32 involves a constrained minimization of the $\chi^2$ function $$\chi^2 = \sum_{i=1}^{3} \frac{(G_i - g_i)^2}{\sigma_{g,i}^2} + \sum_{i=1}^{3} \frac{(H_i - h_i)^2}{\sigma_{h,i}^2}$$

where the $\sigma_{g,i}$ and $\sigma_{h,i}$ represent the gravitational and magnetic field uncertainties determined at functional block 30.

The preferred method of performing the constrained $\chi^2$ minimization is by the method of Lagrange multipliers which serves to introduce the three a priori constraints (the scalar magnitude of the earth's gravitational field ($G_o$), the scalar magnitude of the earth's magnetic field intensity ($H_o$), and the complement of the earth's magnetic dip angle ($\eta$) into the minimization. The $\chi^2$ function is thus modified as is known in the practice of the Lagrange multiplier method to appear as follows:

$$\chi^2 = \sum_{i=1}^{3} \frac{(G_i - g_i)^2}{\sigma_{g,i}^2} + \sum_{i=1}^{3} \frac{(H_i - h_i)^2}{\sigma_{h,i}^2} + \lambda_1\left(G_o^2 - \sum_{i=1}^{3} g_i^2\right) + \lambda_2\left(H_o^2 - \sum_{i=1}^{3} h_i^2\right) + \lambda_3\left(G_o H_o \cos\eta - \sum_{i=1}^{3} g_i h_i\right)$$

In the above relationships, the $\sigma_{g,i}$ and the $\sigma_{h,i}$ are the uncertainties of the gravitational and magnetic field vectors attributable to the uncertainties of each of the measurement axes of the accelerometer and the magnetometer. The uncertainties in the measurement axes arise from uncertainties in the bias, scale factor, and alignment which are values available from the vendors of the magnetometer and accelerometer instrumentation. Additionally, random uncertainty due to the quantization introduced by the digitization of the sensor outputs and the sensor-to-drill collar misalignment are included in the sigmas. The gravitational and magnetic field vector uncertainties may be derived at functional block 30 from the following relationships:

$$\sigma_{gi}^2 = \sum_j \left(\frac{\partial g_i}{\partial \gamma_j}\right)^2 \sigma_{\gamma i}^2 + \sum_{j,k} \left(\frac{\partial g_i}{\partial \gamma_j}\right)\left(\frac{\partial g_i}{\partial \gamma_k}\right)\sigma_{\gamma i \gamma j}^2$$

$$\sigma_{hi}^2 = \sum_j \left(\frac{\partial h_i}{\partial \mu_j}\right)^2 \sigma_{\mu i}^2 + \sum_{j,k} \left(\frac{\partial h_i}{\partial \mu_j}\right)\left(\frac{\partial h_i}{\partial \mu_k}\right)\sigma_{\mu i \mu j}^2$$

where the $\gamma_j$ are sources of uncertainty in the output of the jth accelerometer output (for example, the bias, scale factor, or alignment uncertainty), $\sigma_{\gamma j}^{2}$ is an estimate of the variance of that source of uncertainty, and $\sigma_{\gamma j \gamma k}^2$ is an estimate of the covariance between the various sources of uncertainty. Similarly, the $\mu$, $\sigma_{\mu i}^2$, and $\sigma_{\mu i,\mu j}^2$ are analogous expressions for the sources of error affecting the magnetometer outputs and estimates of their magnitudes. The measured values of $G_i$ and $H_i$ can be used to evaluate the above expressions for $\sigma_{g,i}^2$ and $\sigma_{h,i}^2$ with negligible impact on the minimization of $\chi^2$.

As can be seen from the above relationships, the uncertainties of the magnetic and gravitational field components are dependent on the magnitudes of the measured components $H_i$ and $G_i$ and therefore must be redetermined for each of the surveys performed in the borehole. As a result of this and other computational complexities, the preferred method of practicing the invention is in a computer 22 located at the earth's surface. However, downhole processing in processor 18 is not to be precluded and might very well be the preferred mode were processor 18 to posses sufficient processor and memory capacity.

In the minimization procedure performed at block 32, the partial derivative of the modified $\chi^2$ function is then taken with respect to each of the gravitational and magnetic field components $g_i$ and $h_i$ as well as with respect to the Lagrange multipliers, $\lambda_i$. Each of these partial derivatives are then set equal to zero to obtain a set of nine simultaneous equations. The resultant nine non-linear simultaneous equations are then solved (for example, by a standard numerical routine such as that known to the industry as "IMSL") to obtain values of $g_i$ and the $h_i$ (as well as values for the three Lagrange multipliers $\lambda_i$) which are improved estimates of the accelerometer and magnetometer outputs $g_i$ and $h_i$.

Since, in this procedure, the results $g_i$ and $h_i$ have been constrained to be consistent with the a priori data, the degrees of freedom have been reduced from six to three. As a result, only three unknowns may be determined by this technique, only two of which can be from either the magnetometer or the accelerometer. Once improved components of $g_i$ and $h_i$ have been determined, they are used at 34 in standard equations to calculate the inclination and azimuth of the borehole. The final inclination and azimuth results are output by the processor 22 and recorded by recorder 24 in "log" form.

The effect of a known interference, such as the proximity of a magnetic drill collar, may be incorporated into the above described procedure to produce results for which the perturbation is reduced. Specifically, if a magnetic drill collar has a non-zero component (at the location of the magnetometer) extending along the longitudinal axis of the tool 11, (i.e. the Z axis of the magnetometer), the magnitude of the interfering field may be approximated and used to increase the tool's bias uncertainty at 26. It has been determined through tests and modeling that the above described procedure is not very sensitive to the exact value of the interfering field so that a factor of two approximation will generally suffice. Furthermore, it has been discovered that, where the surveying tool is housed in a non-magnetic drill collar, the effects of spurious magnetic fields from nearby magnetic drill collars in the directions normal to the longitudinal axis (the X and Y axes) of the tool 11 are so slight that they may be ignored with confidence.

As a check of the precision of the results, and therefore of the accuracy of the initial input data $G_i$ and $H_i$, the results may be substituted back into the $\chi^2$ equation above to calculate a $\chi^2$ value. Where the calculated $\chi^2$ value is large (greater than 10 for example) it is apparent (with a 99% confidence level) that the initial data is so inaccurate that it should not be considered to be a reliable survey and possibly discarded. Such inaccuracies may arise in a number of ways such as by the movement of the surveying instrumentation during the process of measurement or the proximity of a variable source of magnetic interference such as a rotating component of a mud motor.

Additionally, it is quite possible that one out of the six survey instrument axes has failed resulting in an high value of $\chi^2$. If a failed axis is suspected, the process may be modified as follows to identify the faulty axis, which is subsequently not used. The $\chi^2$ quantity is repeatedly reformulated and the minimization process repeated, with an artificially large uncertainty, $\sigma$, substituted for the actual uncertainty of one of the six possible axes. Providing an artificially high uncertainty for a specific axis has the effect of minimizing the contribution of the data from that axis to the value of the $\chi^2$ quantity. If no appreciable decrease in the $\chi^2$ value is obtained, it may be concluded that that axis is not the faulty axis and the process is repeated by providing an artificially high uncertainty for another axis. If, however, the value of $\chi^2$ were to drop dramatically, it is apparent that the improvement is caused by the lesser contribution from that axis and the conclusion is that the faulty axis has been identified.

An additional variation that is available using the above technique is to derive additional information on spurious magnetic and gravitational field sources as follows. If it is suspected that the borehole is nearing an adjacent well in which there is a magnetically permeable casing or drill pipe and that the borehole is not changing its orientation, the dip and azimuth values may be used as a portion of the a priori data. In this manner, the results of a number of surveys may be compared with one another. The variations in the results may be assumed to be attributable to the changing proximity of the anomaly as the borehole containing the surveying equipment changes its position relative to the anomaly. Repeated application of this technique may enable determination of the direction and possibly distance to a nearby magnetic field source. For example, after applying this technique, the differences between the measured and fit values of the magnetic field vector at several known distances along the well bore can be used to determine the direction and pole strength of the source of the magnetic anomaly.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for surveying a borehole formed through subsurface geological earth formations comprising the steps of:

a. at an in situ location in said borehole, measuring a plurality of components of the gravitational field strength and a plurality of components of the magnetic field strength;

b. determining an a priori value for the earth's gravitational field at the latitude and longitude of the borehole; and c. in response to said measured components and to said a priori value, determining the azimuth and the inclination of the borehole at said in situ location in the borehole.

2. A method for surveying a borehole formed through subsurface geological earth formations comprising the steps of:

a. at an in situ location in said borehole, measuring, with magnetic and gravitational field responsive measuring instruments, a plurality of components of the gravitational field strength and a plurality of components of the magnetic field strength;

b. determining measurement uncertainties for each of said gravitational and magnetic field components; and c. in response to said measured components and to said measurement uncertainties, determining the azimuth and the inclination of the borehole at said in situ location in the borehole.

3. The method as recited in claim 2 further including the step of determining an a priori value for the earth's gravitational field strength and wherein said step of determining the azimuth and the inclination of the borehole at said in situ location is responsive to said a priori gravitational field strength.

4. The method as recited in one of claims 1 or 3 further including the step of determining a priori values for the earth's magnetic field strength and wherein said step of determining the azimuth of the borehole at said in situ location is responsive to said a priori magnetic field values.

5. The method as recited in claim 1 further including the step of determining the measurement uncertainties for each of said gravitational and magnetic field components and wherein said step of determining the azimuth and the inclination of the borehole at said in situ location is responsive to said measurement uncertainties.

6. The method as recited in one of claims 2 or 5 wherein the measurement uncertainty of each of said magnetic and gravitational field components is determined from the measurement uncertainties of said magnetic and gravitational field responsive measuring instruments.

7. The method as recited in claim 4 further including determining a value representative of the dot product between the earth's gravitational and magnetic field and wherein said step of determining the azimuth and the inclination of the borehole at said in situ location is responsive to said value representative of said dot product.

8. The method as recited in claim 4 wherein said step of determining the azimuth and the inclination of the borehole at said in situ location includes the step of imposing a constrained minimization subject to constraints imposed by one of the members of the group consisting of: said a priori gravitational field value, said magnetic field value and their dot product.

9. The method as recited in claim 8 in which said constrained minimization treats each of said constraints and said magnetic and gravitational field components symmetrically.

10. The method as recited in claim 6 wherein each of said magnetic and gravitational field components are weighted in accordance with its respective measurement uncertainty.

11. The method as recited in claim 4 wherein the quantity $$\chi^2 = \sum_{i=1}^{3} \frac{(G_i - g_i)^2}{\sigma_{g,i}^2} + \sum_{i=1}^{3} \frac{(H_i - h_i)^2}{\sigma_{h,i}^2}$$

is minimized subject to the constraints $$G_o^2 = \sum_{i=1}^{3} g_i^2$$

$$H_o^2 = \sum_{i=1}^{3} h_i^2$$

$$G_o H_o \cos\eta = \sum_{i=1}^{3} g_i h_i$$

where $G_i$ is the ith component of the measured gravitational field, $H_i$ is the ith component of the measured magnetic field, $g_i$ is the improved value of the ith component of the gravitational field, $h_i$ is the improved value of the ith component of the magnetic field, $G_o$ is the a priori magnitude of the gravitational field, $H_o$ is the a priori magnitude of the magnetic field, $\eta$ is the a priori inclination of the magnetic field, $\sigma_{g,i}$ is the measurement uncertainty of the ith component of the gravitational field, and $\sigma_{h,i}$ is the measurement uncertainty of the ith component of the magnetic field.

12. The method as recited in claim 11 wherein said minimization includes the step of minimizing the $\chi^2$ distribution $$\chi^2 = \sum_{i=1}^{3} \frac{(G_i - g_i)^2}{\sigma_{g,i}^2} + \sum_{i=1}^{3} \frac{(H_i - h_i)^2}{\sigma_{h,i}^2} +$$

-continued $$\lambda_1 \left( G_o^2 - \sum_{i=1}^{3} g_i^2 \right) + \lambda_2 \left( H_o^2 - \sum_{i=1}^{3} h_i^2 \right) + \lambda_3 \left( G_o H_o \cos\eta - \sum_{i=1}^{3} g_i h_i \right)$$

with respect to $g_i$, $h_i$ and $\lambda_i$, where $\lambda_1$, $\lambda_2$, and $\lambda_3$ are the Lagrangian multipliers.

13. The method as recited in claim 6 wherein said measurement uncertainties of said magnetic and gravitational field responsive measuring instruments are determined from the group of uncertainties consisting of: scale factor, bias, and alignment of the measuring sensors from which said gravitational and magnetic components are obtained.

14. The method as recited in claim 13 wherein said measurement uncertainties are further, at least in part, determined from a quantization uncertainty resulting from the digitization of said measurements.

15. The method as recited in claim 13 wherein said bias uncertainty includes a component due to residual magnetization of material in said borehole.

16. The method as recited in claim 11 further including the step of calculating the value of $\chi^2$ and comparing $\chi^2$ to a predetermined threshold as an indication of the reliability of said method.

17. The method as recited in claim 11 wherein as few as three of the gravitational and magnetic field components are utilized, at least one of said components being determined from an axis of one of said magnetic and gravitational field measuring instruments and the other two coming from axes of the other of said magnetic and gravitational field measuring instruments.

18. The method as recited in claim 11 wherein said minimization is repeated in order to identify an axis of said magnetic and gravitational field measuring instruments which is faulty, each minimization repetition being performed with an uncertainty on successively different axes which is large relative to the uncertainties utilized for the other of said axes, whereby the faulty axis is identified when $\chi^2$ becomes small.

* * * * *